US006340549B1

(12) United States Patent
Maehata et al.

(10) Patent No.: US 6,340,549 B1
(45) Date of Patent: Jan. 22, 2002

(54) TONER FOR THE DEVELOPMENT OF ELECTROSTATIC IMAGE, PROCESS FOR THE PREPARATION THEREOF, DEVELOPER FOR THE DEVELOPMENT OF ELECTROSTATIC IMAGE AND PROCESS FOR THE FORMATION OF IMAGE

(75) Inventors: Hideo Maehata; Yasuo Matsumura; Hisae Yoshizawa; Masaaki Suwabe, all of Minamiashigara (JP)

(73) Assignee: Fuji Xerox Co., Ltd., Tokyo (JP)

( * ) Notice: Subject to any disclaimer, the term of this patent is extended or adjusted under 35 U.S.C. 154(b) by 0 days.

(21) Appl. No.: 09/663,098

(22) Filed: Sep. 15, 2000

(30) Foreign Application Priority Data

Mar. 15, 2000 (JP) ..... 12-071570

(51) Int. Cl.[7] ..... G03G 9/10
(52) U.S. Cl. ..... 430/111.4; 430/126; 430/137.21
(58) Field of Search ..... 430/106, 108, 430/110, 111.4, 137.21, 126

(56) References Cited

U.S. PATENT DOCUMENTS 5,182,181 A * 1/1993 Koizumi et al. ..... 430/108
5,340,678 A 8/1994 Suzuki et al. ..... 430/125
5,766,814 A * 6/1998 Baba et al. ..... 430/108
5,919,593 A * 7/1999 Karima et al. ..... 430/108

FOREIGN PATENT DOCUMENTS

| | | |
|---|---|---|
| EP | 0 867 778 A2 | 3/1998 |
| JP | 62-266558 | 11/1987 |
| JP | 63-195659 | 8/1988 |
| JP | 5072798 | 3/1993 |
| JP | 07271090 | 10/1995 |
| JP | 9211892 | 8/1997 |
| JP | 10228129 | 8/1998 |
| JP | 2000-122347 | 4/2000 |

* cited by examiner

*Primary Examiner*—John Goodrow
(74) *Attorney, Agent, or Firm*—Oliff & Berridge, PLC

(57) ABSTRACT

The foregoing problem is solved with a toner for the development of an electrostatic image obtained by externally adding agglomerated particles to toner particles containing a binder resin and a colorant, characterized in that the agglomerated particles are made of (i) a particulate resin alone, (ii) a particulate lubricant alone or (iii) at least two particulate materials selected from the group consisting of particulate resin, particulate lubricant and inorganic particulate material and have a shape factor of 130 or more and a volume-average particle diameter of from 0.5 $\mu$m to 10 $\mu$m.

24 Claims, No Drawings

TONER FOR THE DEVELOPMENT OF ELECTROSTATIC IMAGE, PROCESS FOR THE PREPARATION THEREOF, DEVELOPER FOR THE DEVELOPMENT OF ELECTROSTATIC IMAGE AND PROCESS FOR THE FORMATION OF IMAGE

BACKGROUND OF THE INVENTION

The present invention relates to a toner for the development of an electrostatic image for use in the development of an electrostatic latent image in electrophotography or electrostatic recording method, a process for the preparation thereof, a developer for the development of an electrostatic image, and a process for the formation of an image.

A method for rendering an image data visible via electrostatic image such as electrophotography has been used in various fields. In electrophotography, an electrostatic latent image is formed on a photoreceptor at a charging/exposure step. The electrostatic latent image is developed with a developer containing a toner, and then processed at a transferring step and a fixing step to become visible. Examples of the developer to be used in electrophotography include two-component developer comprising a toner and a carrier and one-component developer comprising a magnetic or non-magnetic toner alone. Such a toner is normally prepared by a knead-grinding method which comprises melt-kneading a thermoplastic resin with a pigment, a static controller and a release agent such as wax, cooling the mixture, finely grinding the mixture, and then classifying the particles. In this method, inorganic or organic particles may be attached to the surface of the toner particles to improve the fluidity or removability of the toner.

On the other hand, with the recent development of advanced information-oriented society, there has been a growing demand for the provision of data documents built by various methods in an even higher image quality. Thus, the enhancement of image quality is understudy in various arts of image formation. This demand has been given to every art of image formation, not excepting image formation methods using electrophotography. In electrophotography, the development of technique for reducing a particulate toner having a reduced particle diameter and a sharp grain size distribution and making toner particles spherical is now under way to realize an even higher precision in color image formation.

Referring to the process for making toner particles spherical, the shape of the resulting toner particles has an effect on the precision in transferring of toner particles at the transferring step. The more spherical the toner particles can be kept until the final image is obtained, the smaller is the contact area of the toner particles with the carrier and hence the higher is the precision in transferring of toner particles and the more can be expected the enhancement of final image quality such as reproducibility of fine line.

However, there is a problem that when such spherical toner particles are used, the toner particles which have been left untransferred from the carrier can be hardly removed.

In order to remove the untransferred toner, a method using a blade is widely used because the device is simple and durable. In this blade cleaning method, however, it is much likely that spherical toner particles can be passed by the blade because of its shape, causing poor removability leading to deterioration of image quality. Thus, the art must consider how spherical toner particles used for higher image quality can be removed.

In order to solve this problem, some approaches have been attempted. One of these approaches is to raise the linear pressure applied to the edge of the blade, preventing the toner particles from being passed by the blade. However, this approach is disadvantageous in that the mere rise in linear pressure accelerates the abrasion of the edge of the blade and the carrier and causes the blade to vibrate and give noise.

In order to eliminate such noise and abrasion, an approach has been proposed which comprises supplying a particulate lubricant into the edge of the blade to reduce the friction coefficient of the edge of the blade. In order to efficiently reduce the friction coefficient of the edge of the blade with a lubricant thus supplied, the particle diameter of the particulate lubricant is preferably as small as about 0.2 $\mu$m or less. However, these submicron lubricant particles can be scattered inside the machine, staining the static charger or like parts and hence causing malcharging or like defects. The resulting image has a deteriorated quality.

Further, an approach has been proposed which comprises supplying onto the edge of the blade submicron irregular shape inorganic particles that then form a sealing material on the edge of the blade to make it difficult for spherical toner particles to be passed by the blade. This approach is based on a mechanism that spherical toner particles which can be otherwise easily passed by the blade are trapped by irregular shape particles such as irregular shape silica and alumina which have been supplied onto the blade of the blade. However, this approach, too, is disadvantageous in that the particle diameter of the irregular shape particles needs to be about 0.2 $\mu$m or less to be efficiently supplied onto the edge of the blade and prevent the spherical toner particles from being passed by the blade similarly to the foregoing lubricant. In this approach, too, problems arise as in the case of the foregoing lubricant.

SUMMARY OF THE INVENTION

Therefore, an object of the present invention is to solve the foregoing problems. In other words, an object of the present invention is to provide a toner for the development of an electrostatic image which can give solution to the problems with poor removability of spherical toner particles without causing the foregoing problem of stain of the static charger or other parts with scattered submicron particles, a process for the preparation thereof, a developer for the development of an electrostatic image and a process for the formation of an image.

The inventors made extensive studies. As a result, the inventors found the use of a toner for the development of an electrostatic image formed by externally adding to spherical toner particles a predetermined amount of agglomerated particles having a shape factor of 130 or more and a volume-average particle diameter of from 0.5 $\mu$m to 10 $\mu$m which are made of (i) a particulate resin alone, (ii) a particulate lubricant alone or (iii) at least two particulate materials selected from the group consisting of particulate resin, particulate lubricant and inorganic particulate material. It is found that such agglomerated particles, if used, are disintegrated under load developed at the forward end of the cleaning member to form irregular shape particles having a diameter of 0.2 $\mu$m or less which are then effectively supplied into the edge portion of the cleaning member, making it possible to solve the foregoing problems with poor removability of spherical toner particles without causing the foregoing stain of the static charger with scattered submicron particles. In other words, the inventors found the following inventions <1>to <19>.

<1>A toner for the development of an electrostatic image comprising toner particles containing a binder resin and a colorant, and additive, said additive being agglomerated particles, characterized in that the agglomerated particles are made of (i) a particulate resin alone, (ii) a particulate lubricant alone or (iii) at least two particulate materials selected from the group consisting of particulate resin, particulate lubricant and inorganic particulate material and have a shape factor of 130or more as represented by the following equation I and a volume-average particle diameter of from 0.5 $\mu$m to 10 $\mu$m:

$$\text{Shape factor}=(ML^2/A)\times(\pi/4)\times 100 \quad \text{(I)}$$

wherein ML represents the absolute maximum length of agglomerated particles, and A represents the projected area of agglomerated particles.

<2>The toner for the development of an electrostatic image according to Clause <1>, wherein the toner particles preferably have a shape factor of 125 or less and a volume-average particle diameter of 1 $\mu$m or more.

<3>The toner for the development of an electrostatic image according to Clause <1>, wherein the toner particles preferably further comprise a release agent incorporated therein.

<4>The toner for the development of an electrostatic image according to any one of Clauses <1>to <3>, wherein the amount of the agglomerated particles is preferably from 0.3 parts by weight to 10 parts by weight based on 100 parts by weight of the sum of the amount of the toner particles and the agglomerated particles.

<5>A process for the preparation of a toner for the development of an electrostatic image comprising a step of preparing dispersions selected from the group consisting of the following dispersions (i) to (iii), a step of stirring or mixing the dispersions, a step of agglomerating the material thus stirred or mixture to form agglomerated particles, and a step of mixing the agglomerated particles thus formed with toner particles to obtain a toner for the development of an electrostatic image:

(i) particulate resin dispersion;

(ii) particulate lubricant dispersion; and (iii) at least two dispersions selected from the group consisting of particulate resin dispersion, particulate lubricant dispersion and inorganic particulate material dispersion.

<6>The process for the preparation of a toner for the development of an electrostatic image according to Clause <5>, wherein the toner particles are preferably obtained by steps of mixing at least one particulate resin dispersion and at least one colorant dispersion to form mixed particles, agglomerating the mixed particles to form an agglomerate of mixed particles and heating the agglomerate to a temperature of not lower than the glass transition point of said resin so that the agglomerate undergoes coalescence.

<7>The process for the preparation of a toner for the development of an electrostatic image according to Clause <5>or <6>, wherein the toner particles preferably have a shape factor of 125 or less as represented by the following equation and a volume-average particle diameter of 1 $\mu$m or more:

$$\text{Shape factor}=(ML^2/A)\times(\pi/4)\times 100$$

wherein ML represents the absolute maximum length of agglomerated particles, and A represents the projected area of agglomerated particles.

<8>The process for the preparation of a toner for the development of an electrostatic image according to Clause <6>or <7>, wherein the step of forming mixed particles preferably involves the preparation of at least one release agent dispersion which is then mixed with the particulate resin dispersion and colorant dispersion.

<9>The process for the preparation of a toner for the development of an electrostatic image according to any one of Clauses <5>to <8>, wherein the amount of the agglomerated particles is preferably from 0.3 parts by weight to 10 parts by weight based on 100 parts by weight of the sum of the amount of the toner particles and the agglomerated particles.

<10>A developer for the development of an electrostatic image comprising a toner for the development of an electrostatic image and a carrier, characterized in that the toner for the development of an electrostatic image is obtained by externally adding agglomerated particles to toner particles containing a binder resin and a colorant and the agglomerated particles are made of (i) a particulate resin alone, (ii) a particulate lubricant alone or (iii) at least two particulate materials selected from the group consisting of particulate resin, particulate lubricant and inorganic particulate material and have a shape factor of 130 or more as represented by the foregoing equation I and a volume-average particle diameter of from 0.5 $\mu$m to 10 $\mu$m.

<11>The developer for the development of an electrostatic image according to Clause <10>, wherein the toner particles preferably have a shape factor of 125 or less as represented by the following equation and a volume-average particle diameter of 1 $\mu$m or more:

$$\text{Shape factor}=(ML^2/A)\times(\pi/4)\times 100$$

wherein ML represents the absolute maximum length of agglomerated particles, and A represents the projected area of agglomerated particles.

<12>The developer for the development of an electrostatic image according to Clause <10>or <11>, wherein the toner particles preferably further have a release agent incorporated therein.

<13>The developer for the development of an electrostatic image according to any one of Clauses <10>to <12>, wherein the amount of the agglomerated particles preferably is from 0.3 parts by weight to 10 parts by weight based on 100 parts by weight of the sum of the amount of the toner particles and the agglomerated particles.

<14>A process for the formation of an image comprising a step of forming an electrostatic latent image on an electrostatic carrier, a step of developing the electrostatic latent image with a developer to form a toner image on a developer carrier and a step of transferring the toner image onto a transferring material, characterized in that the developer is a toner for the development of an electrostatic image or comprises the toner for the development of an electrostatic image and a carrier, the toner for the development of an electrostatic image is obtained by externally adding agglomerated particles to toner particles containing a binder resin and a colorant and the agglomerated particles are made of (i) a particulate resin alone, (ii) a particulate lubricant alone or (iii) at least two particulate materials selected from the group consisting of particulate resin, particulate lubricant and inorganic particulate material and have a shape factor of 130 or more as represented by the foregoing equation I and a volume-average particle diameter of from 0.5 $\mu$m to 10 $\mu$m.

<15>The process for the formation of an image according to Clause <14>, wherein the toner particles preferably have a shape factor of 125 or less as represented by the foregoing equation I and a volume-average particle diameter of 1 $\mu$m or more, wherein ML represents the absolute maximum length of agglomerated particles, and A represents the projected area of agglomerated particles.

<16>The process for the formation of an image according to Clause <14>or <15>, wherein the toner particles preferably further have a release agent incorporated therein.

<17>The process for the formation of an image according to any one of Clauses <14>to <16>, wherein the amount of the agglomerated particles preferably is from 0.3 parts by weight to 10 parts by weight based on 100 parts by weight of the sum of the amount of the toner particles and the agglomerated particles.

<18>The process for the formation of an image according to any one of Clauses <14>to <17>, wherein the transferring step is preferably followed by a cleaning step of recovering the toner for the development of an electrostatic image remaining on the electrostatic latent image carrier.

<19>The process for the formation of an image according to Clause <18>, wherein the cleaning step is preferably followed by a recycling step of returning said toner for the development of an electrostatic image recovered at the cleaning step to the developer layer.

DETAILED DESCRIPTION OF THE PREFERRED EMBODIMENTS

The present invention will be further described hereinafter.

The toner for the development of an electrostatic image of the invention is obtained by externally adding agglomerated particles to toner particles. The toner particles will be firstly described further hereinafter, followed by the description of the agglomerated particles.

The toner particles to be incorporated in the toner for the development of an electrostatic image of the invention comprises a binder resin and a colorant as main components, and optionally a release agent or release agent resin.

As the binder resin to be incorporated in the toner particles of the invention there maybe used a binder resin which has heretofore been used for toner. Thus, the binder resin to be incorporated in the toner particles is not specifically limited.

Specific examples of the binder resin employable herein include styrenes such as styrene, parachlorostyrene and α-methylstyrene, acrylic monomers such as methyl acrylate, ethyl acrylate, n-propyl acrylate, lauryl acrylate and 2-ethylhexyl acrylate, methylacrylic monomers such as methyl methacrylate, ethyl methacrylate, n-propyl methacrylate, lauryl methacrylate and 2-ethylhexyl methacrylate, ethylenically unsaturated monomers such as acrylic acid, methacrylic acid and sodium styrenesulfonate, vinylnitriles such as acrylonitrile and methacrylonitrile, vinylethers such as vinyl methyl ether and vinyl isobutyl ether, vinylketones such as vinyl methyl ketone, vinyl ethyl ketone and vinyl isopropenyl ketone, homopolymers of monomers such as olefin (e.g., ethylene, propylene, butadiene), copolymers of two or more of these monomers, mixtures of these monomers, nonvinyl condensed resins such as epoxy resin, polyester resin, polyurethane resin, polyamide resin, cellulose resin and polyether resin, mixtures thereof with the foregoing vinyl resins, graft polymers obtained by the polymerization of vinyl monomers in the presence thereof.

As mentioned above, the toner particles of the invention may comprise a release agent or release agent resin incorporated therein. The release agent or release agent resin may be incorporated as a part of the foregoing binder resin component. Examples of the release agent employable herein include low molecular polyolefins such as polyethylene, polypropylene and polybutene, aliphatic acid amides such as silicone, oleic acid amide, erucic acid amide, ricinoleic acid amide and stearic acid amide, vegetable-based waxes such as carnauba wax, rice wax, candelilla wax, Japan wax and jojoba oil, animal-based waxes such as beeswax, mineral and petroleum-based waxes such as montan wax, ozokerite, ceresin wax, paraffin wax, microcrystalline wax and Fischer-Tropsch wax, and modification products thereof.

At least one of these release agents is preferably incorporated in the toner particles.

As the colorant to be incorporated in the toner particles of the invention there may be used a colorant which has heretofore been known. Thus, the colorant to be incorporated is not specifically limited. Examples of the colorant employable herein include various pigments such as carbon black, chrome yellow, Hansa yellow, benzidine yellow, threne yellow, quinoline yellow, permanent orange GTR, pyrazolone orange, vulcan orange, Watchung red, permanent red, brilliant carmine 3B, brilliant carmine 6B, Du pont oil red, pyrazolone red, lithol red, rhodamine B lake, lake red C, rose bengale, aniline blue, ultramarine blue, chalcoil blue, methylene blue chloride, phthalocyanine blue, phthalocyanine green and malachite green oxalate, and various dyes such as acridine-based dye, xanthene-based dye, azo-based dye, benzoquinone-based dye, azine-based dye, anthraquinone-based dye, thioindigo-based dye, dioxazine-based dye, thiazine-based dye, azomethine-based dye, indigo-based dye, thioindigo-based dye, phthalocyanine dye, aniline black-based dye, polymethine-based dye, triphenylmethane-based dye, diphenylmethane-based dye, thiazine-based dye, thiazole-based dye and xanthene-based dye. These colorants may be used singly or in combination of two or more thereof.

The toner particles of the invention may comprise various components incorporated therein besides the foregoing components to control various characteristics thereof. The particulate toner, if used as a magnetic toner, may comprise a magnetic powder (e.g., ferrite, magnetite), a metal such as reduced iron, cobalt, nickel and manganese, alloy thereof or compound containing these metals incorporated therein. If necessary, the particulate tone may further comprise various common static controllers such as quaternary ammonium salt, nigrosine compound and triphenylmethane-based pigment incorporated therein.

The toner particles of the invention comprising the foregoing components have a shape factor of 125 or less, preferably 120 or less, more preferably 118 or less, and a volume-average particle diameter of 1 μm or less, preferably from 3 μm to 8 μm, more preferably from 4 μm to 7 μm. When the shape factor of the toner particles falls within the above defined range, the resulting image quality is desirable. When the volume-average particle diameter of the toner particles is too low, it is disadvantageous in that sufficient removability and developability can hardly be obtained.

The shape factor is represented by the following equation I wherein ML represents the absolute maximum length of agglomerated particles, and A represents the projected area of agglomerated particles.

$$\text{Shape factor}=(ML^2/A)\times(90/4)\times 100 \quad \text{(I)}$$

The method for obtaining the toner particles satisfying the foregoing requirements is not specifically limited. Examples of the preparation method employable herein include a dry process high speed mechanical impact method which comprises applying a mechanical impact to irregular shape toner particles obtained by ordinary grinding method to make the toner particles spherical in such a manner that the foregoing requirements are satisfied, a wet melt method which comprises making irregular shape toner particles spherical in a dispersant, and method for the preparation of toner by known polymerization method such as suspension polymerization, dispersion polymerization and emulsion polymerization cohesion.

The toner particles thus obtained maybe treated with any known external additive.

The agglomerated particles to be incorporated in the toner for the development of an electrostatic image of the invention will be further described hereinafter.

The agglomerated particles to be incorporated in the toner for the development of an electrostatic image of the invention are made of (i) a particulate resin alone, (ii) a particulate lubricant alone or (iii) at least two particulate materials selected from the group consisting of particulate resin, particulate lubricant and inorganic particulate material.

The clause (i) will be firstly described.

The particulate resin of the invention can be made of (i) a particulate resin alone.

The material to be used as the particulate resin is not specifically limited. For example, various components described above as binder resin may be used.

These resin components may be subjected to existing known resin grinding method or existing emulsification or dispersion method in a liquid medium such as water and organic solvent to prepare a desired particulate resin. For example, a polymerization method in a nonuniform dispersion system such as emulsion polymerization, suspension polymerization and dispersion polymerization may be effected to easily obtain a particulate resin dispersion having the particulate resin dispersed therein. Any other methods such as method which comprises adding a uniformly polymerized particulate resin obtained by solution polymerization or bulk polymerization to a solvent in which the polymer cannot be dissolved together with a stabilizer may be effected to obtain a particulate resin dispersion having the particulate resin dispersed therein.

In the case where a vinyl-based monomer is used to obtain the particulate resin, emulsion polymerization method or seed polymerization method using an ionic surfactant, preferably in combination with a nonionic surfactant, may be effected to prepare a particulate resin dispersion. Other resins, if it is oil-based and can be dissolved in a solvent having a relatively low water solubility, may be dispersed in water in the form of solution in the solvent together with an ionic surfactant or high molecular electrolyte by means of a dispersing machine such as homogenizer to prepare a fine aqueous dispersion which is then heated or put under reduced pressure to vaporize the solvent, thereby preparing the desired resin dispersion.

Examples of the surfactant employable herein include anionic surfactants such as sulfuric acid ester salt-based surfactant, sulfonic acid salt-based surfactant, phosphoric acid ester-based surfactant and soap-based surfactant, cationic surfactants such as amine salt-based surfactant and quaternary ammonium salt-based surfactant, nonionic surfactants such as polyethylene glycol-based surfactant, alkylphenol ethylene oxide adduct-based surfactant and polyvalent alcohol-based surfactant, and various graft polymers. Thus, the surfactant to be used herein is not specifically limited.

Alternatively, the particulate resin of the invention can be made of (ii) a particulate lubricant alone.

The lubricant to be used in the invention is adapted to accelerate slippage of the cleaning member with a carrier such as photoreceptor and hence reduce friction therebetween.

Examples of the lubricant employable herein include graphite, molybdenum disulfite, zinc stearate, calcium stearate, and magnesium stearate. Further examples of the lubricant employable herein include those described above as release agent, e.g., low molecular polyolefins such as polyethylene, polypropylene and polybutene, aliphatic acid amides such as silicone, oleic acid amide, erucic acid amide, ricinoleic acid amide and stearic acid amide, vegetable-based waxes such as carnauba wax, rice wax, candelilla wax, Japan wax and jojoba oil, animal-based waxes such as beeswax, mineral and petroleum-based waxes such as montan wax, ozokerite, ceresin wax, paraffin wax, microcrystalline wax and Fischer-Tropsch wax, and modification products thereof.

These lubricant components may be subjected to existing mechanical grinding method or emulsification or dispersion method in a liquid medium in the same manner as with the foregoing particulate resin to prepare a particulate lubricant or particulate resin dispersion.

Further, the agglomerated particles of the invention are made of (iii) at least two particulate materials selected from the group consisting of particulate resin, particulate lubricant and inorganic particulate material. In other words, he agglomerated particles of the invention are made of (iii)-(a) a particulate resin and a particulate lubricant, (iii)-(b) a particulate resin and an inorganic particulate material, (iii)-(c) a particulate lubricant and an inorganic particulate material or (iii)-(d) a particulate resin, a particulate lubricant and an inorganic particulate material.

As the material of the particulate resin and particulate lubricant there may be used those described above.

Examples of the material of the inorganic particulate material employable herein include silica, alumina, zinc oxide, cerium oxide, iron oxide, strontium titanate, titanium oxide, calcium carbonate, magnesium carbonate, and tricalcium phosphate.

The shape of the inorganic particulate material is preferably irregular shape such as acicular having a great aspect ratio as represented by the ratio of long axis length to short axis length.

These inorganic particulate materials may be subjected to existing mechanical grinding method or emulsification or dispersion method in a liquid medium in the same manner as with the foregoing particulate resin to prepare an inorganic particulate material or inorganic particulate material dispersion.

The foregoing particulate resin, particulate lubricant or inorganic particulate material may be prepared in the manner as mentioned above. The particle diameter of these particulate materials is preferably 0.2 $\mu$m or less.

The process for the preparation of agglomerated particles made of two or more of the foregoing particulate materials is not specifically limited. In practice, however, the agglomerated particles can be prepared in the following manner. Examples of the preparation method employable herein include a method which comprises mechanically mixing the foregoing particles in dry process to form agglomerated particles, an electrical agglomeration method in a liquid medium, and a physical agglomeration using a high molecular flocculating agent.

In this case, the system can be optionally heated during or after the preparation of agglomerate to control the cohesive force or adhesivity between the particulate resin and/or particulate lubricant and the inorganic particulate material, making it possible to adjust the strength of the agglomerated particles against disintegrating force.

The method for the preparation of agglomerated particles made of two or more of the foregoing particulate materials will be briefly described in connection with specific examples. In some detail, various dispersions having these particulate materials dispersed therein are mixed to form mixed particles which are then agglomerated to form an agglomerate of mixed particles, thereby preparing agglomerated particles. In the case where the agglomerated particles contain a particulate resin or particulate lubricant, the foregoing agglomerate is preferably heated to a temperature of not lower than the glass transition point of the particulate resin or particulate lubricant to undergo coalescence, thereby forming agglomerated particles.

The agglomerate thus prepared acts as a sealing compound in the edge portion of the cleaning member in the image forming apparatus. Thus, the volume-average particle diameter of the agglomerate is from 0.5 μm to 10 μm, preferably from 0.7 μm to 5 μm, more preferably from 1 m to 3 μm. When the volume-average particle diameter of the agglomerate falls below 0.5 μm, the particles can be easily scattered inside the developing machine, giving a tendency toward stain in the interior of the image forming apparatus. On the contrary, when the volume-average particle diameter of the agglomerate exceeds 10 μm, the agglomerated particles cannot be sufficiently supplied as sealing compound into the edge portion of the cleaning member, occasionally making it impossible to obtain good removability.

The agglomerated particles of the invention preferably have a shape factor of 130 or more, more preferably from 135 to 150, even more preferably from 140 to 145. When the shape factor of the agglomerated particles is too low, a tendency is given that the agglomerate cannot sufficiently act as a sealing compound. The shape factor is represented by the following equation I where ML represents the absolute maximum length of agglomerated particles, and A represents the projected area of agglomerated particles.

$$\text{Shape factor}=(ML^2/A)\times(\pi/4)\times 100 \quad (I)$$

The agglomerated particles of the invention are preferably free of colorant. This is because even when some of the agglomerated particles of the invention are transferred and fixed on the final image together with the toner particles, image defects must be prevented.

By externally adding the agglomerated particles thus obtained to the foregoing toner particles at a predetermined mixing ratio, the toner for the development of an electrostatic image of the invention, particularly accomplishing high image quality and good removability at the same time, can be prepared.

In this case, the proportion of the agglomerated particles is from 0.3 to 10 parts by weight, preferably from 0.5 to 5 parts by weight, more preferably from 1 to 3 parts by weight based on 100 parts by weight of the sum of that of the toner particles and the agglomerated particles.

When the added amount of the agglomerated particles falls below 0.3 parts by weight, a tendency can be given that a sufficient cleaning effect cannot be exerted. On the contrary, when the added amount of the agglomerated particles exceeds 10 parts by weight, a tendency can be given that the resulting toner has remarkably impaired chargeability and fluidity.

The toner for the development of an electrostatic image thus obtained can be used as a one-component developer comprising the toner alone or a two-component developer comprising the toner and a carrier.

The toner for the development of an electrostatic image thus obtained can be used in the following image forming method. In other words, the toner for the development of an electrostatic image of the invention is preferably used in an image forming method comprising a step of forming an electrostatic latent image on an electrostatic carrier, a step of developing an electrostatic latent image with a developer to form a toner image on a developer carrier and a step of transferring the toner image onto a transferring material, wherein the developer is the foregoing toner for the development of an electrostatic image or comprises the toner for the development of an electrostatic image or a carrier.

In the image forming method, the transferring step is preferably followed by a cleaning step of recovering the toner for the development of an electrostatic image remaining on the electrostatic latent image carrier.

Further, in the image forming method, the cleaning step is preferably followed by a recycling step of returning the toner for the development of an electrostatic image recovered at the cleaning step to the developer layer.

EXAMPLE

The present invention will be further described in the following examples and comparative examples.

As the toner particles and agglomerated particles constituting the toner for the development of an electrostatic image of the invention, a particulate toner X-1 and agglomerated particles Y-1 to Y-4 are prepared by the following emulsion polymerization agglomeration method.

Comparative Example 1

Particulate resin dispersions A-1 and A-2, a particulate release agent dispersion B-1, and a pigment dispersion C-1 are previously prepared by the following methods. These dispersions are then used to prepare the following particulate toner X-1.

Particulate Resin Dispersion A-1

A solution comprising a mixture of the following components is prepared.

| | |
|---|---|
| Styrene | 370 parts by weight |
| n-Butyl acrylate | 30 parts by weight |
| Acrylic acid | 6 parts by weight |
| Dodecanethiol | 24 parts by weight |
| Carbon tetrabromide | 4 parts by weight |

A solution of 434 g of the solution thus obtained, 6 g of a nonionic surfactant (Nonipole 400, produced by SANYO CHEMICAL INDUSTRIES, LTD.) and 10 g of an anionic surfactant (Neogen R, produced by DAIICHI PHARMACEUTICAL CO., LTD.) in 550 g of ion-exchanged ion is subjected to dispersion and emulsification in a flask. 50 g of ion-exchanged water having 4 g of ammonium persulfate dissolved therein is then poured into the emulsion with slow stirring in 10 minutes. Thereafter, the air in the flask is thoroughly replaced by nitrogen. The emulsion is then heated with stirring over an oil bath until the temperature of the interior of the system reached 70° C. Under these conditions, emulsion polymerization continued for 5 hours to obtain the particulate resin dispersion A-1.

The latex obtained from the particulate resin dispersion A-1 is then measured for volume-average particle diameter ($D_{50}$) of resin particles by means of a laser diffraction type grain size distribution measuring instrument (LA-700, produced by HORIBA, Ltd.). The results are 155 nm. The latex is then measured for glass transition point of resin at a temperature rise rate of 10° C./min by means of a differential scanning calorimeter (DSC-50, produced by Shimadzu Corp.). The results are 59° C. The latex is also measured for weight-average molecular weight (in polystyrene equivalence) in THF as a solvent by means of a molecular weight measuring instrument (HLC-8020, produced by TOSOH CORP.). The results are 13,000. (Particulate resin dispersion A-2)

A solution comprising a mixture of the following components is prepared.

| | |
|---|---|
| Styrene | 280 parts by weight |
| n-Butyl acrylate | 120 parts by weight |
| Acrylic acid | 8 parts by weight |

A solution of 408 g of the solution thus obtained, 6 g of a nonionic surfactant (Nonipole 400, produced by SANYO CHEMICAL INDUSTRIES, LTD.) and 12 g of an anionic surfactant (Neogen R, produced by DAIICHI PHARMACEUTICAL CO., LTD.) in 550 g of ion-exchanged ion is subjected to dispersion and emulsification in a flask. 50 g of ion-exchanged water having 3 g of ammonium persulfate dissolved therein is then poured into the emulsion with slow stirring in 10 minutes. Thereafter, the air in the flask is thoroughly replaced by nitrogen. The emulsion is then heated with stirring over an oil bath until the temperature of the interior of the system reached 70° C. Under these conditions, emulsion polymerization continued for 5 hours to obtain the particulate resin dispersion A-2.

The latex of the particulate resin dispersion A-2 thus obtained is then measured for various properties in the same manner as the particulate resin dispersion A-1. As a result, the particulate resin exhibited a volume-average particle diameter of 105 nm, a glass transition point of 53° C. and a weight-average molecular weight of 550,000.

Particulate Release Agent Dispersion B-1

The following components are subjected to thorough dispersion while being heated to a temperature of 95° C. by a homogenizer (Ultratalax T50, produced by LKA Corp.), and then moved to a pressure-discharging type homogenizer where they are then subjected to dispersion to obtain a particulate release agent dispersion B-1 comprising a particulate release agent having a volume-average particle diameter ($D_{50}$ ) of 550 nm.

| | |
|---|---|
| Paraffin wax (HNPO190; m.p.: 85° C., produced by Nippon Seiro Co., Ltd.) | 50 parts by weight |
| Cationic surfactant (Sanisole B50, produced Kao Corp.) | 5 parts by weight |
| Ion-exchanged water | 200 parts by weight |

(Pigment Dispersion C-1)

The following components are subjected to dispersion by a homogenizer (Ultratalax T50, produced by LKA Corp.), and then further subjected to dispersion by an ultrasonic homogenizer to obtain a blue pigment dispersion C-1 having a volume-average particle diameter ($D_{50}$ ) of 150 nm.

| | |
|---|---|
| Phthalocyanine pigment (PB-FAST BLUE, produced by GASF Corp.) | 50 parts by weight |
| Anionic surfactant (Neogen R, DAIICHI PHARMACEUTICAL CO., LTD.) | 5 parts by weight |
| Ion-exchanged water | 200 parts by weight |

(Preparation of Particulate Toner X-1)

The following components are subjected to thorough mixing and dispersion in a round stainless steel flask by a homogenizer (UltratalaxT50, produced by LKA Corp.). The dispersion is then heated to a temperature of 50° C. with stirring over a heating oil bath. The dispersion is then kept at the same temperature for 30 minutes. The temperature of the heating oil bath is then raised to 55° C. The dispersion is then kept at the same temperature for 1 hour to adjust the particle diameter and particle diameter distribution of the agglomerated toner particles X-1.

| | |
|---|---|
| Particulate resin dispersion A-1 | 120 parts by weight |
| Particulate resin dispersion A-2 | 80 parts by weight |
| Release agent dispersion B-1 | 40 parts by weight |
| Pigment dispersion C-1 | 11.3 parts by weight |
| Cationic surfactant (Sanisole B50, produced by Kao Corp.) | 0.5 parts by weight |

In this case, the particulate toner X-1 is measured for volume-average particle diameter ($D_{50}$) by means of a coal tar counter (TAII, produced by Japan Scientific Instrument Co., Ltd.). The results are 5.0 $\mu$m. The volume-average particle diameter distribution coefficient (GSDv) is 1.21. For the definition of volume-average particle diameter ($D_{50}$) and volume-average particle diameter distribution coefficient (GSDv), cumulative distribution is drawn from the small particle diameter side at various grain size ranges (channel) obtained by dividing the grain size distribution to be measured by every particle diameter. The particle diameter at the point where volume accumulation reaches 16% on the cumulative distribution is defined as D16. Similarly, the particle diameter at the point where volume accumulation reaches 50% on the cumulative distribution is defined as D50, and the particle diameter at the point where volume accumulation reaches 84% on the cumulative distribution is defined as D84. D50 is defined as volume-average particle diameter $D_{50}$. The value obtained from $(D84/D16)^{1/2}$ is defined as volume-average particle diameter distribution coefficient GSDv.

To the dispersion of agglomerated toner particles is added 3 g of an anionic surfactant (Neogen R, produced by DAIICHI PHARMACEUTICAL CO., LTD.) to stop the agglomeration of particles and hence stabilize the agglomerated toner particles. Thereafter, the stainless steel flask is sealed. Using a magnetic seal, the dispersion is heated to a temperature of 93° C. with continued stirring. This state is then kept for 5 hours so that the agglomerated toner particles are coalesced to adjust the shape and shape distribution thereof. In this case, the coalesced toner particles are measured for volume-average particle diameter ($D_{50}$) by means of a coal tar counter (TAII, produced by Japan Scientific Instrument Co., Ltd.). The results are 5.0 $\mu$m. The volume-average grain size distribution coefficient (GSDv) is 1.21.

The coalesced toner particles are cooled, filtered, thoroughly washed with ion-exchanged water having a pH value of 10 and then with ion-exchanged water having a pH value of 6.5, and then dried by a freeze dryer to obtain a particulate toner X-1. The particulate toner thus obtained is then measured for volume-average particle diameter ($D_{50}$) by means of a coal tar counter (TAII, produced by Japan Scientific Instrument Co., Ltd.). The results are 5.0 $\mu$m. The volume-average grain size distribution coefficient (GSDv) is 1.21.

The particulate toner X-1 is also observed for surface conditions under an electron microscope. As a result, the particulate toner X-1 is observed to have a continuous surface layer made of coalesced resin particles. A section of the particulate toner X-1 is observed under a transmission electron microscope. As a result, little or no pigment is observed exposed to the exterior of the toner particles. Using a luzex image analyzer (LUZEXIII, produced by Nikolet Co., Ltd.), 100 toner particles are measured for length of periphery (ML) and projected area (A). From the measurements is then calculated ($ML^2/A$). The shape factor SF values are then averaged. The central shape factor is 115.

(Preparation of Developer Z-1)

To 100 g of the particulate toner is added 0.43 g of a hydrophobicized silica (TS720, produced by Cabot Specialty Chemicals Inc.). The mixture is then subjected to blending by a sample mill. The foregoing external additive toner is then measured out in such an amount that the toner concentration is 5% by weight based on the weight of a ferrite carrier having an average particle diameter of 50 μm coated with a polymethyl methacrylate (produced by Soken chemical & Engineering Co., Ltd.). The two components are then blended with stirring by a ball mill for 5 minutes to prepare a developer Z-1.

The developer Z-1 thus prepared is then evaluated for removability and image quality (reproducibility of fine line, reproducibility of gradation, graininess of highlight) in the following manner. The results are set forth in Table 1.

(Evaluation)

(1) Evaluation of Removability

Using a remodeled version of a Type 3310 Color Laser Wind copying machine (produced by Fuji Xerox Co., Ltd.) with the developer thus prepared, an image having a percent area of 5% is outputted onto 20,000 sheets of J-coat paper produced by Fuji Xerox Co., Ltd. as a final transferring paper at a temperature of 22° C. and a humidity of 55%. The image on 20,000 sheets are then observed for occurrence of linear or stripe-shaped image defects due to poor removability. For the evaluation of removability, the following criterion is used.

○: No image defects are observed up to 20,000 sheets

XX: Image defects occur up to 100 sheets (2) Evaluation of Image Quality

Under the same conditions as in Clause (1), an image is outputted onto 20,000 sheets. The images are then evaluated for quality. Evaluation is made for (i) reproducibility of fine line, (ii) reproducibility of gradation, and (iii) graininess of highlight. When any image defects due to poor removability occurred in the various evaluations, all the image qualities are judged poor (XX).

(2)-(i) Reproducibility of Fine Line

An image of fine line is formed on the photoreceptor in such a manner that the width of line is 50 μm. The image thus formed is then transferred and fixed. The image of fine line fixed on the transferring material is then observed at a magnification power of 175 under a Type VH-6200 micro highscope (produced by KEYENCE CORP.). For the evaluation of this image quality, the following criterion is used. Those with the symbol ◎ are acceptable.

◎: Fine line is uniformly filled with toner and has no disturbance at the edge

XX: Fine line is not uniformly filled with toner and has remarkable notches at the edge (2)-(ii) Reproducibility of Gradation Gradient images having a percent image area of 10%, 20%, 30% , 40%, 50%, 60%, 70%, 80%, 90% and 100% are formed. Using X-rite 404, these images are then measured for image density and evaluated for gradation. For the evaluation of this image quality, the following criterion is used. Those with the symbol ◎ are acceptable.

◎: Gradation is very good with all gradient images having an image area ranging from low to high values XX: The range of reproduction of gradation is slightly narrow and gradation is unstable at high and low image area portions (2)-(iii) Graininess of Highlight Gradient images having a percent image area of 5% and 10% are formed. The images thus formed are then visually observed to evaluate the graininess of highlight. For the evaluation of this image quality, the following criterion is used. Those with the symbol ◎ are acceptable.

◎: Graininess is very good both with 5% and 10% image areas.

XX: Graininess is poor both with 5% and 10% image areas.

Example 1

Use of Irregular Shape Agglomerated Particles Y-1 Made of Particulate Lubricant and Particulate Resin (Preparation of Particulate Lubricant Dispersion D-1)

The following components are subjected to thorough dispersion while being heated to a temperature of 95° C. by a homogenizer (Ultratalax T50, produced by LKA Corp.), and then moved to a pressure-discharging type homogenizer where they are then subjected to dispersion to obtain a particulate lubricant dispersion D-1 comprising a particulate lubricant having a volume-average particle diameter ($D_{50}$) of 400 nm.

| | |
|---|---|
| Zinc stearate | 50 parts by weight |
| Anionic surfactant (Neogen R, DAIICHI PHARMACEUTICAL CO., LTD.) | 5 parts by weight |
| Ion-exchanged water | 200 parts by weight |

(Preparation of Irregular Shape Agglomerated Particles Y-1)

200 parts by weight of the particulate resin dispersion A-1 prepared in Comparative Example 1 and 450 parts by weight of the foregoing particulate lubricant dispersion D-1 are subjected to thorough mixing and dispersion with 0.5 parts by weight of a cationic surfactant (Sanisole 150, produced by Kao Corp.) in a round stainless steel flask by a homogenizer (UltratalaxT50, produced by LKA Corp.). The dispersion is then heated to a temperature of 35° C. with stirring over a heating oil bath. The dispersion is then kept at the same temperature for 30 minutes. The temperature of the heating oil bath is then raised to 40° C. The dispersion is then kept at the same temperature for 1 hour to adjust the particle diameter and particle diameter distribution of the agglomerated particles. The agglomerated particles are then measured for volume-average particle diameter ($D_{50}$). The results are 3.1 μm. The volume-average particle diameter distribution coefficient (GSDv) is 1.30.

To the dispersion of agglomerated toner particles is added 3 g of an anionic surfactant (Neogen R, produced by DAIICHI PHARMACEUTICAL CO., LTD.) to stop the agglomeration of particles and hence stabilize the agglomerated toner particles. Thereafter, the stainless steel flask is sealed. Using a magnetic seal, the dispersion is heated to a temperature of 60° C. with continued stirring. This state is then kept for 30 hours. The dispersion is then cooled to obtain a particulate material (Y-1)'. The particulate material (Y-1)' is measured for volume-average particle diameter ($D_{50}$) by means of a coal tar counter. The results are 3.1 μm. The volume-average particle diameter distribution coefficient (GSDv) is 1.30.

The particulate material (Y-1)' thus obtained is observed for surface conditions under an electron microscope. The particulate resin in the particulate resin dispersion A-1 and the particulate lubricant in the particulate lubricant dispersion D-1 are each observed having a primary particle interface. However, the particulate material (Y-1)' is observed free of continuous resin layer as observed in the particulate toner X-1.

The particulate material (Y-1)' is filtered, thoroughly washed with ion-exchanged water having a pH value of 6.5, and then dried by a freeze dryer to obtain irregular shape agglomerated particles Y-1. The irregular shape agglomerated particles Y-1 are then measured for volume-average particle diameter ($D_{50}$). The results are 3.1 $\mu$m. The volume-average particle diameter distribution coefficient (GSDv) is 1.30. The shape factor SF of these irregular shape agglomerated particles Y-1 are then averaged. As a result, the central shape factor is 140.

(Preparation of Developer Z-2)

Subsequently, 3 parts by weight of the irregular shape agglomerated particles Y-1 and 97.4 parts by weight of the externally treated particulate toner X-1 obtained in Comparative Example 1 are blended by a sample mill to obtain a toner for the development of an electrostatic image. The toner thus prepared is then mixed with a carrier in an amount such that the toner concentration is 5%. The carrier used is a ferrite carrier having an average particle diameter of 50 $\mu$m coated with a polymethyl methacrylate (produced by Soken chemical & Engineering Co., Ltd.) in an amount of 1%. The mixture is then subjected to stirring and mixing in a ball mill for 5 minutes to prepare a developer Z-2. The developer Z-2 thus prepared is evaluated for removability and image quality (reproducibility of fine line, reproducibility of gradation, graininess of highlight) in the same manner as in Comparative Example 1. The results are set forth in Table 1.

Example 2

Use of Irregular Shape Agglomerated Particles Y-2 Made of Particulate Resin and Inorganic Particulate Material (Preparation of Inorganic Particulate Material Dispersion E-1)

The following components are subjected to dispersion by a homogenizer (Ultratalax T50, produced by LKA Corp.), and then subjected to dispersion by a supersonic homogenizer to obtain an inorganic particulate material (particulate silica) dispersion E-1 comprising a particulate silica having a volume-average particle diameter ($D_{50}$) of 150 nm.

| | |
|---|---|
| Silica | 50 parts by weight |
| Anionic surfactant (Neogen R, DAIICHI PHARMACEUTICAL CO., LTD.) | 5 parts by weight |
| Ion-exchanged water | 200 parts by weight |

(Preparation of Irregular Shape Agglomerated Particles Y-2)

Agglomerated particles (Y-2)' having a volume-average particle diameter ($D_{50}$) of 2.8 $\mu$m and a volume-average particle diameter distribution of 1.31 are obtained in the same manner as in Example 1 except that 450 parts by weight of the inorganic particulate material dispersion E-1 thus obtained is used instead of the particulate lubricant dispersion D-1 used in Example 1. The agglomerated particles (Y-2)' thus obtained are filtered, washed, and then dried in the same manner as in Example 1 to obtain irregular shape agglomerated particles Y-2 having a final volume-average particle diameter ($D_{50}$) of 2.8 $\mu$m, a volume-average particle diameter distribution of 1.31 and a central shape factor of 145.

(Preparation of Developer Z-3)

Subsequently, 3 parts by weight of the irregular shape agglomerated particles Y-2 and 97.4 parts by weight of the externally treated particulate toner X-1 obtained in Comparative Example 1 are blended by a sample mill to obtain a toner for the development of an electrostatic image. The toner thus prepared is then mixed with a carrier in an amount such that the toner concentration is 5%. The carrier used is a ferrite carrier having an average particle diameter of 50 $\mu$m coated with a polymethyl methacrylate (produced by Soken chemical & Engineering Co., Ltd.) in an amount of 1%. The mixture is then subjected to stirring and mixing in a ball mill for 5 minutes to prepare a developer Z-3. The developer Z-3 thus prepared is evaluated for removability and image quality (reproducibility of fine line, reproducibility of gradation, graininess of highlight) in the same manner as in Comparative Example 1. The results are set forth in Table 1.

Example 3

Use of Irregular Shape Agglomerated Particles Y-3 Made of Particulate Lubricant and Inorganic Particulate Material (Preparation of Irregular Shape Agglomerated Particles Y-3)

Agglomerated particles (Y-3)' having a volume-average particle diameter ($D_{50}$) of 4.5 $\mu$m and a volume-average particle diameter distribution of 1.40 are obtained in the same manner as in Example 1 except that 450 parts by weight of the inorganic particulate material dispersion E-1 thus obtained is used instead of the particulate resin dispersion A-1 used in Example 1. The agglomerated particles (Y-3)' thus obtained are filtered, washed, and then dried in the same manner as in Example 1 to obtain irregular shape agglomerated particles Y-3 having a final volume-average particle diameter ($D_{50}$) of 4.5 $\mu$m, a volume-average particle diameter distribution of 1.40 and a central shape factor of 145.

(Preparation of Developer Z-4)

Subsequently, 3 parts by weight of the irregular shape agglomerated particles Y-3 and 97.4 parts by weight of the externally treated particulate toner X-1 obtained in Comparative Example 1 are blended by a sample mill to obtain a toner for the development of an electrostatic image. The toner thus prepared is then mixed with a carrier in an amount such that the toner concentration is 5%. The carrier used is a ferrite carrier having an average particle diameter of 50 $\mu$m coated with a polymethyl methacrylate (produced by Soken chemical & Engineering Co., Ltd.) in an amount of 1%. The mixture is then subjected to stirring and mixing in a ball mill for 5 minutes to prepare a developer Z-4. The developer Z-4 thus prepared is evaluated for removability and image quality (reproducibility of fine line, reproducibility of gradation, graininess of highlight) in the same manner as in Comparative Example 1. The results are set forth in Table 1.

Example 4

Use of Irregular Shape Agglomerated Particles Y-4 Made of Particulate Resin, Particulate Lubricant and Inorganic Particulate Material (Preparation of Irregular Shape Agglomerated Particles Y-4)

Agglomerated particles (Y-4)' having a volume-average particle diameter ($D_{50}$) of 3.5 $\mu$m and a volume-average particle diameter distribution of 1.29 are obtained in the same manner as in Example 1 except that 200 parts by weight of the foregoing particulate resin dispersion A-1, 225 parts by weight of the foregoing particulate lubricant dispersion D-1 and 225 parts by weight of the foregoing inorganic particulate material dispersion E-1 thus obtained are used. The agglomerated particles (Y-4)' thus obtained are filtered, washed, and then dried in the same manner as in Example 1 to obtain irregular shape agglomerated particles Y-4 having a final volume-average particle diameter ($D_{50}$) of 3.5 μm, a volume-average particle diameter distribution of 1.29 and a central shape factor of 138.

(Preparation of Developer Z-5)

Subsequently, 3 parts by weight of the irregular shape agglomerated particles Y-4 and 97.4 parts by weight of the externally treated particulate toner X-1 obtained in Comparative Example 1 are blended by a sample mill to obtain a toner for the development of an electrostatic image. The toner thus prepared is then mixed with a carrier in an amount such that the toner concentration is 5%. The carrier used is a ferrite carrier having an average particle diameter of 50 μm coated with a polymethyl methacrylate (produced by Soken chemical & Engineering Co., Ltd.) in an amount of 1%. The mixture is then subjected to stirring and mixing in a ball mill for 5 minutes to prepare a developer Z-5. The developer Z-5 thus prepared is evaluated for removability and image quality (reproducibility of fine line, reproducibility of gradation, graininess of highlight) in the same manner as in Comparative Example 1. The results are set forth in Table 1.

Example 5

Use of Irregular Shape Agglomerated Particles Y-5 Made of Particulate Resin Alone (Preparation of Irregular Shape Agglomerated Particles Y-5)

Agglomerated particles (Y-5)' having a volume-average particle diameter ($D_{50}$of 3.5 μm and a volume-average particle diameter distribution of 1.23 are obtained in the same manner as in Example 1 except that 200 parts by weight of the foregoing particulate resin dispersion A-1 alone are used. The agglomerated particles (Y-5)' thus obtained are filtered, washed, and then dried in the same manner as in Example 1 to obtain irregular shape agglomerated particles Y-5 having a final volume-average particle diameter ($D_{50}$) of 3.5 μm, a volume-average particle diameter distribution of 1.23 and a central shape factor of 145.

(Preparation of Developer Z-6)

Subsequently, 3 parts by weight of the irregular shape agglomerated particles Y-5 and 97.4 parts by weight of the externally treated particulate toner X-1 obtained in Comparative Example 1 are blended by a sample mill to obtain a toner for the development of an electrostatic image. The toner thus prepared is then mixed with a carrier in an amount such that the toner concentration is 5%. The carrier used is a ferrite carrier having an average particle diameter of 50 μm coated with a polymethyl methacrylate (produced by Soken chemical & Engineering Co., Ltd.) in an amount of 1%. The mixture is then subjected to stirring and mixing in a ball mill for 5 minutes to prepare a developer Z-6. The developer Z-6 thus prepared is evaluated for removability and image quality (reproducibility of fine line, reproducibility of gradation, graininess of highlight) in the same manner as in Comparative Example 1. The results are set forth in Table 1.

Example 6

Use of Irregular Shape Agglomerated Particles Y-6 Made of Particulate Lubricant Alone (Preparation of Irregular Shape Agglomerated Particles Y-6)

Agglomerated particles (Y-6)' having a volume-average particle diameter ($D_{50}$) of 4.0 μm and a volume-average particle diameter distribution of 1.30 are obtained in the same manner as in Example 1 except that 200 parts by weight of the foregoing particulate lubricant dispersion D-1 alone are used. The agglomerated particles (Y-6)' thus obtained are filtered, washed, and then dried in the same manner as in Example 1 to obtain irregular shape agglomerated particles Y-6 having a final volume-average particle diameter ($D_{50}$) of 4.0 μm, a volume-average particle diameter distribution of 1.30 and a central shape factor of 143.

(Preparation of Developer Z-7)

Subsequently, 3 parts by weight of the irregular shape agglomerated particles Y-6 and 97.4 parts by weight of the externally treated particulate toner X-1 obtained in Comparative Example 1 are blended by a sample mill to obtain a toner for the development of an electrostatic image. The toner thus prepared is then mixed with a carrier in an amount such that the toner concentration is 5%. The carrier used is a ferrite carrier having an average particle diameter of 50 μm coated with a polymethyl methacrylate (produced by Soken chemical & Engineering Co., Ltd.) in an amount of 1%. The mixture is then subjected to stirring and mixing in a ball mill for 5 minutes to prepare a developer Z-7.

The developer Z-7 thus prepared is evaluated for removability and image quality (reproducibility of fine line, reproducibility of gradation, graininess of highlight) in the same manner as in Comparative Example 1. The results are set forth in Table 1.

Example 7

(Preparation of Pigment Dispersion C-2)

The following components are subjected to dispersion by a homogenizer in the same manner as in Comparative Example 1 to obtain a yellow pigment dispersion C-2 having a volume-average particle diameter of 130 nm.

| | |
|---|---|
| Yellow pigment (produced by DAINICHISEIKA COLOUR & CHEMICALS MFG. CO., LTD.) | 50 parts by weight |
| Anionic surfactant (Neogen R, DAIICHI PHARMACEUTICAL CO., LTD.) | 5 parts by weight |
| Ion-exchanged water | 200 parts by weight |

(Preparation of Particulate Toner X-2)

The following components are subjected to mixing and dispersion by a homogenizer in the same manner as in Comparative Example 1, and then heated to a temperature of 55° C. where they are then kept to form agglomerated particles. The agglomerated particles thus formed are heated to a temperature of 93° C. so that they are coalesced, washed, and then dried to obtain a particulate toner X-2 having a volume-average particle diameter of 5.1 μm, a volume-average particle diameter distribution of 1.21 and a central shape factor of 115.

| | |
|---|---|
| Particulate resin dispersion A-1 | 120 parts by weight |
| Particulate resin dispersion A-2 | 80 parts by weight |
| Release agent dispersion B-1 | 40 parts by weight |
| Pigment dispersion C-2 | 12 parts by weight |
| Cationic surfactant (Sanisole B50, produced by Kao Corp.) | 0.5 parts by weight |

(Preparation of Developer Z-8)

Subsequently, the foregoing particulate toner (X-2) is externally treated in the same manner as in Comparative Example 1. 97.4 parts by weight of the externally treated particulate toner (X-2) thus obtained and 3 parts by weight of the irregular shape agglomerated particles Y-4 obtained in Example 4 and are blended by a sample mill to obtain a toner for the development of an electrostatic image. The toner thus prepared is then mixed with a carrier in an amount such that the toner concentration is 5%. The carrier used is a ferrite carrier having an average particle diameter of 50 μm coated with a polymethyl methacrylate (produced by Soken chemical & Engineering Co., Ltd.) in an amount of 1%. The mixture is then subjected to stirring and mixing in a ball mill for 5 minutes to prepare a developer Z-8.

The developer Z-8 thus prepared is evaluated for removability and image quality (reproducibility of fine line, reproducibility of gradation, graininess of highlight) in the same manner as in Comparative Example 1. The results are set forth in Table 1.

Example 8

(Preparation of Pigment Dispersion C-3)

The following components are subjected to dispersion by a homogenizer in the same manner as in Comparative Example 1 to obtain a red pigment dispersion C-3 having a volume-average particle diameter of 120 nm.

| | |
|---|---|
| Red pigment (produced by Clariant Co., Ltd.) | 50 parts by weight |
| Anionic surfactant (Neogen R, DAIICHI PHARMACEUTICAL CO., LTD.) | 5 parts by weight |
| Ion-exchanged water | 200 parts by weight |

(Preparation of Particulate Toner X-3)

The following components are subjected to mixing and dispersion by a homogenizer in the same manner as in Comparative Example 1, and then heated to a temperature of 55° C. where they are then kept to form agglomerated particles. The agglomerated particles thus formed are heated to a temperature of 93° C. so that they are coalesced, washed, and then dried to obtain a particulate toner X-3 having a volume-average particle diameter of 5.5 μm, a volume-average particle diameter distribution of 1.21 and a central shape factor of 115.

| | |
|---|---|
| Particulate resin dispersion A-1 | 120 parts by weight |
| Particulate resin dispersion A-2 | 80 parts by weight |
| Release agent dispersion B-1 | 40 parts by weight |
| Pigment dispersion C-3 | 12 parts by weight |
| Cationic surfactant (Sanisole B50, produced by Kao Corp.) | 0.5 parts by weight |

(Preparation of Particulate Lubricant Dispersion D-2)

The following components are subjected to dispersion by a homogenizer in the same manner as with the particulate lubricant dispersion D-1 of Comparative Example 1 to obtain a particulate lubricant dispersion D-2 having a volume-average particle diameter of 230 nm.

| | |
|---|---|
| Polypropylene wax (Polywax 725, produced by Petrolite Co., Ltd.) | 50 parts by weight |
| Anionic surfactant (Neogen R, DAIICHI PHARMACEUTICAL CO., LTD.) | 5 parts by weight |
| Ion-exchanged water | 200 parts by weight |

(Preparation of Irregular Shape Agglomerated Particles Y-7)

Agglomerated particles (Y-7) having a volume-average particle diameter ($D_{50}$) of 3.5 μm and a volume-average particle diameter distribution of 1.25 are obtained in the same manner as with the irregular shape particles Y-1 of Example 1 except that the foregoing lubricant D-2 is used instead of the particulate resin dispersion D-1. The agglomerated particles (Y-7) thus obtained are filtered, washed, and then dried in the same manner as in Example 1 to obtain irregular shape agglomerated particles Y-7 having a final volume-average particle diameter ($D_{50}$) of 3.5 μm, a volume-average particle diameter distribution of 1.27 and a central shape factor of 144.

(Preparation of Developer Z-9)

Subsequently, the foregoing particulate toner (X-3) is externally treated in the same manner as in Comparative Example 1. 97.4 parts by weight of the externally treated particulate toner (X-3) thus obtained and 3 parts by weight of the foregoing irregular shape agglomerated particles Y-7 and are blended by a sample mill to obtain a toner for the development of an electrostatic image. The toner thus prepared is then mixed with a carrier in an amount such that the toner concentration is 5%. The carrier used is a ferrite carrier having an average particle diameter of 50 μm coated with a polymethyl methacrylate (produced by Soken chemical & Engineering Co., Ltd.) in an amount of 1%. The mixture is then subjected to stirring and mixing in a ball mill for 5 minutes to prepare a developer Z-9.

The developer Z-9 thus prepared is evaluated for removability and image quality (reproducibility of fine line, reproducibility of gradation, graininess of highlight) in the same manner as in Comparative Example 1. The results are set forth in Table 1.

TABLE 1

| | | Comparative Example 1 | Example 1 | Example 2 | Example 3 | Example 4 | Example 5 | Example 6 | Example 7 | Example 8 |
|---|---|---|---|---|---|---|---|---|---|---|
| Toner particles | Pigment | Phthalo-cyanine | Phthalo-cyanine | Phthalo-cyanine | Phthalo-cyanine | Phthalo-cyanine | Phthalo-cyanine | Phthalo-cyanine | Yellow | Magenta |
| | particle diameter (μm) | 5.0 | 5.0 | 5.0 | 5.0 | 5.0 | 5.0 | 5.0 | 5.1 | 5.5 |
| | Shape factor | 115 | 115 | 115 | 115 | 115 | 115 | 115 | 115 | 115 |
| Irregular shape agglomerated particles | Particulate resin | — | St/BA/AA | St/BA/AA | — | St/BA/AA | St/BA/AA | — | St/BA/AA | St/BA/AA |
| | Particulate lubricant | — | Zinc stearate | — | Zinc stearate | Zinc stearate | — | Zinc stearate | Zinc stearate | Poly-propylene |
| | Inorganic particulate material | — | — | Silica | Silica | Silica | — | — | Silica | — |
| | Particle diameter (μm) | — | 3.1 | 2.8 | 4.5 | 4.5 | 3.5 | 4.0 | 4.5 | 3.5 |
| | Shape factor | — | 140 | 145 | 145 | 145 | 145 | 143 | 145 | 144 |

TABLE 1-continued

| | | Comparative Example 1 | Example 1 | Example 2 | Example 3 | Example 4 | Example 5 | Example 6 | Example 7 | Example 8 |
|---|---|---|---|---|---|---|---|---|---|---|
| Mixing ratio of Irregular shape agglomerated particles | Wt-% | 0 | 3 | 3 | 3 | 3 | 3 | 3 | 3 | 3 |
| Removability | | XX | ○ | ○ | ○ | ○ | ○ | ○ | ○ | ○ |
| Image quality | Reproducibility of fine line | XX | ⊙ | ⊙ | ⊙ | ⊙ | ⊙ | ⊙ | ⊙ | ⊙ |
| | Reproducibility of gradation | XX | ⊙ | ⊙ | ⊙ | ⊙ | ⊙ | ⊙ | ⊙ | ⊙ |
| | Graininess of highlight | XX | ⊙ | ⊙ | ⊙ | ⊙ | ⊙ | ⊙ | ⊙ | ⊙ |

St: styrene; BA: n-Butyl acrylate; AA: Acrylic acid

As can be seen in Table 1, the developer of comparative example, which comprised a toner having no irregular shape particles externally added thereto, provided undesired results both in removability and image quality. On the other hand, the developers of Examples 1 to 6, which comprised a toner having irregular shape particles externally added thereto, exhibited drastically improved removability, making it possible to provide a high quality image.

In accordance with the present invention, the problems with the prior at can be solved. In other words, the present invention can give solution to the problems with poor removability of spherical toner particles without causing stain of the static charger or other parts with scattered submicron particles.

What is claimed is:

1. A toner for the development of an electrostatic image comprising:

toner particles containing a binder resin and a colorant, and additive, said additive being agglomerated particles, wherein said agglomerated particles are made of (i) a particulate resin alone, (ii) a particulate lubricant alone or (iii) at least two particulate materials selected from the group consisting of particulate resin, particulate lubricant and inorganic particulate material, and have a shape factor of 130 or more as represented by the following equation and a volume-average particle diameter of from 0.5 $\mu$m to 10 $\mu$m:

$$\text{Shape factor}=(ML^2/A)\times(\pi/4)\times 100$$

wherein ML represents the absolute maximum length of agglomerated particles, and A represents the projected area of agglomerated particles.

2. The toner for the development of an electrostatic image according to claim 1, wherein said toner particles have a shape factor of 125 or less and a volume-average particle diameter of 1 $\mu$m or more.

3. The toner for the development of an electrostatic image according to claim 1, wherein said toner particles further comprise a release agent incorporated therein.

4. The toner for the development of an electrostatic image according to claim 1, wherein the amount of said agglomerated particles is from 0.3 parts by weight to 10 parts by weight based on 100 parts by weight of the sum of the amount of said toner particles and said agglomerated particles.

5. The toner for the development of an electrostatic image according to claim 1, wherein said agglomerated particles comprise at least two particulate materials selected from the group consisting of particulate resin, particulate lubricant and inorganic particulate material.

6. The toner for the development of an electrostatic image according to claim 1, wherein the average particle diameter of said particulate resin, particulate lubricant and inorganic particulate material is 0.2 $\mu$m or less.

7. A process for the preparation of a toner for the development of an electrostatic image comprising:

a step of preparing dispersions selected from the group consisting of the following dispersions (i) to (iii), a step of stirring or mixing said dispersions, a step of agglomerating the material thus stirred or mixture to form agglomerated particles, and a step of mixing the agglomerated particles thus formed with toner particles to obtain a toner for the development of an electrostatic image:

(i) particulate resin dispersion;

(ii) particulate lubricant dispersion; and (iii) at least two dispersions selected from the group consisting of particulate resin dispersion, particulate lubricant dispersion and inorganic particulate material dispersion.

8. The process for the preparation of a toner for the development of an electrostatic image according to claim 7, wherein said toner particles are obtained by steps of:

mixing at least one particulate resin dispersion and at least one colorant dispersion to form mixed particles, agglomerating said mixed particles to form an agglomerate of mixed particles, and heating said agglomerate to a temperature of not lower than the glass transition point of said resin so that said agglomerate undergoes coalescence.

9. The process for the preparation of a toner for the development of an electrostatic image according to claim 7, wherein said toner particles have a shape factor of 125 or less as represented by the following equation and a volume-average particle diameter of 1 $\mu$m or more:

$$\text{Shape factor}=(ML^2/A)\times(\pi/4)\times 100,$$

and wherein

ML represents the absolute maximum length of agglomerated particles, and A represents the projected area of agglomerated particles.

10. The process for the preparation of a toner for the development of an electrostatic image according to claim 8, wherein said step of forming mixed particles involves the preparation of at least one release agent dispersion which is then mixed with said particulate resin dispersion and colorant dispersion.

11. The process for the preparation of a toner for the development of an electrostatic image according to claim 7, wherein the amount of said agglomerated particles is from 0.3 parts by weight to 10 parts by weight based on 100 parts by weight of the sum of the amount of said toner particles and said agglomerated particles.

12. The process for the preparation of a toner for the development of an electrostatic image according to claim 7, wherein the average particle diameter of said particulate resin, particulate lubricant and inorganic particulate material is 0.2 $\mu$m or less.

13. A developer for the development of an electrostatic image comprising a toner for the development of an electrostatic image and a carrier, wherein said toner for the development of an electrostatic image is obtained by externally adding agglomerated particles to toner particles containing binder resin and a colorant and said agglomerated particles are made of (i) a particulate resin alone, (ii) a particulate lubricant alone or (iii) at least two particulate materials selected from the group consisting of particulate resin, particulate lubricant and inorganic particulate materials, and have a shape facto of 130 or more as represented by the following equation and volume-average particle diameter of from 0.5 $\mu$m to 10 $\mu$m:

$$\text{Shape factor}=(ML^2/A)\times(\pi/4)\times 100$$

wherein ML represents the absolute maximum length of agglomerated particles, and A represents the projected area of agglomerated particles.

14. The developer for the development of an electrostatic image according to claim 13, wherein said toner particles have a shape factor of 125 or less as represented by the following equation and volume-average particles diameter of 1 $\mu$m or more:

$$\text{Shape factor}=(ML^2/A)\times(\pi/4)\times 100,$$

and wherein

ML represents the absolute maximum length of agglomerated particles, and A represents the projected area of agglomerated particles.

15. A process for the formation of an image comprising:

a step of forming an electrostatic latent image on an electrostatic carrier, a step of developing said electrostatic latent image with a developer to form a toner image on a developer carrier, and a step of transferring said toner image onto a transferring material, wherein said developer is a toner for the development of an electrostatic image or comprises said toner for the development of an electrostatic image and a carrier, said toner for the development of an electrostatic image is obtained by externally adding agglomerated particles to toner particles containing a binder resin and a colorant and said agglomerated particles are made of (i) a particulate resin alone, (ii) a particulate lubricant alone or (iii) at least two particulate materials selected from the group consisting of particulate resin, particulate lubricant and inorganic particulate material, and have a shape factor of 130 or more as represented by the following equation and a volume-average particle diameter of from 0.5 $\mu$m to 10 $\mu$m:

$$\text{Shape factor}=(ML^2/A)\times(\pi/4)\times 100$$

wherein ML represents the absolute maximum length of agglomerated particles, and A represents the projected area of agglomerated particles.

16. The process for the formation of an image according to claim 15, wherein said toner particles have a shape factor of 125 or less as represented by the following equation and a volume-average particle diameter of 1 $\mu$m or more:

$$\text{Shape factor}=(ML^2/A)\times(\pi/4)\times 100$$

wherein ML represents the absolute maximum length of agglomerated particles, and A represents the projected area of agglomerated particles.

17. The process for the formation of an image according to claim 15, wherein said transferring step is followed by a cleaning step of recovering the toner for the development of an electrostatic image remaining on said electrostatic latent image carrier.

18. The process for the formation of an image according to claim 17, wherein said cleaning step is followed by a recycling step of returning said toner for the development of an electrostatic image recovered at said cleaning step to the developer layer.

19. The toner for the development of an electrostatic image according to claim 1, wherein said toner particles have a volum-average particle diameter of 3 $\mu$m or more and 8 $\mu$m or less.

20. The toner for the development of an electrostatic image according to claim 1, wherein said toner particles have a volume-average particle diameter of 4 $\mu$m or more and 7 $\mu$m or less.

21. The process for the preparation of a toner for the development of an electrostatic image according to claim 7, wherein the amount of said agglomerated particles is from 0.5 parts by weight to 5 parts by weight based on 100 parts by weight of the sum of the amount of said toner particles and said agglomerated particles.

22. The process for the preparation of a toner for the development of an electrostatic image according to claim 7, wherein the amount of said agglomerated particles is from 1 part by weight to 3 parts by weight based on 100 parts by weight of the sum of the amount of said toner particles and said agglomerated particles.

23. The toner for the development of an electrostatic image according to claim 1, wherein said agglomerated particles have a volume-average particle diameter of 0.7 $\mu$m or more and 5 $\mu$m or less.

24. The toner for the development of an electrostatic image according to claim 1, wherein said agglomerated particles have a volume-average particle diameter of 1 $\mu$m or more and 3 $\mu$m or less.

* * * * *